United States Patent [19]

Karner

[11] 4,391,395

[45] Jul. 5, 1983

[54] CLOTHES HANGER

[75] Inventor: Franz Karner, Lidköping, Sweden

[73] Assignee: Karner & Co AB, Lidköping, Sweden

[21] Appl. No.: 315,303

[22] Filed: Oct. 23, 1981

Related U.S. Application Data

[63] Continuation of Ser. No. 37,955, May 9, 1979, abandoned.

[30] Foreign Application Priority Data

May 11, 1978 [SE] Sweden ..... 7805391

[51] Int. Cl.[3] ..... A41D 27/22

[52] U.S. Cl. ..... 223/94

[58] Field of Search ..... 223/89, 90, 94

[56] References Cited

U.S. PATENT DOCUMENTS

| | | | |
|---|---|---|---|
| 1,697,719 | 1/1929 | Daigle | 223/89 |
| 2,629,525 | 2/1953 | Peterson | 223/94 X |

FOREIGN PATENT DOCUMENTS

| | | | |
|---|---|---|---|
| 40488 | 7/1929 | Denmark | 223/94 |
| 644731 | 6/1928 | France | 223/94 |
| 6501668 | 9/1965 | Netherlands | 223/94 |
| 1189093 | 4/1970 | United Kingdom | 223/94 |

*Primary Examiner*—Wm. Carter Reynolds

*Attorney, Agent, or Firm*—Irvin A. Lavine

[57] ABSTRACT

A clothes-hanger comprises a tubular central portion, a suspension member disposed on the central portion, two end pieces, of which at least one is telescopic in the central portion and whose outer ends are provided with gripping portions for engagement with the article of clothing which is to be hung up, a compression spring disposed between an abutment in the central portion and the end piece shiftably disposed in the central portion, and a locking device connected to this end piece and disposed to prevent the compression spring from shifting the end piece beyond its outer position. The locking device is shiftably disposed in a slot provided in the lower region of the central portion, such that the locking device, in the outer position of the end piece, engages with the outer defining edge of the slot.

5 Claims, 3 Drawing Figures

CLOTHES HANGER

This application is a continuation of copending application Ser. No. 37,955, filed May 9, 1979, now abandoned.

The present invention relates to a clothes-hanger comprising a tubular central portion, a suspension member disposed on the central portion, two end pieces of which at least one is telescopically shiftable in the central portion in order to be movable between an inner and an outer position in the central portion and whose outer ends are provided with gripping portions for engagement with the article of clothing which is to be hung up, a compression spring disposed between an abutment in the central portion and the end piece shiftably disposed in the central portion, and a locking device which is connected to this end piece and is operative to prevent the compression spring from shifting the end piece beyond its outer position.

Prior art clothes-hangers, in which the distance between the gripping portions is variable, possess the disadvantage that the spring mechanism and locking devices which interconnect the shiftable parts of the clothes-hanger and the frame tend to fail after lengthy, repeated use.

The major aspect of the present invention is to realize a clothes-hanger of the type disclosed by way of introduction which obviates the disadvantages inherent in prior art clothes-hangers and, at the same time, makes for simple manufacture and assembly of the component parts of the clothes-hanger.

To this end, the locking device is shiftably disposed in a slot provided in the lower region of the central portion, such that the locking device, in the outer position of the end piece, engages with the outer defining edge of the slot.

The nature of the present invention and its aspects will be more readily understood from the following brief description of the accompanying drawings, which show one embodiment, and discussion relating thereto.

Figure 1:
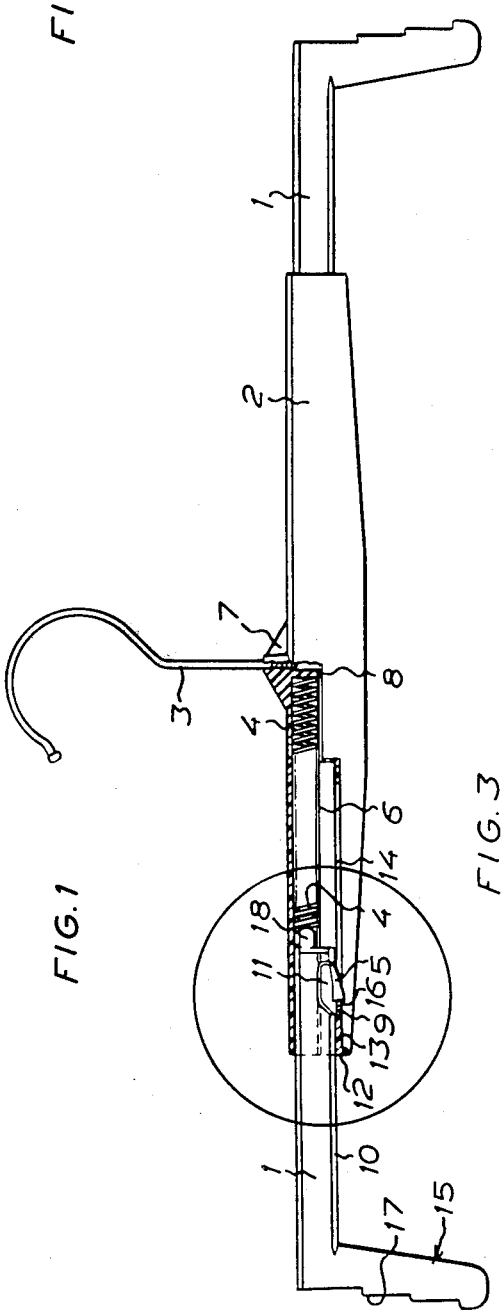
FIG. 1 is a front elevation, partially in section, of a clothes-hanger according to the invention.
Figure 3:
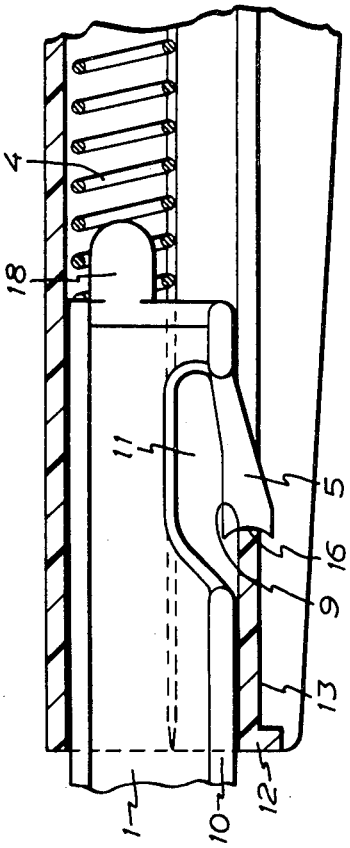
FIG. 3 shows, on a larger scale, the encircled region of FIG. 1.

The clothes-hanger according to the invention comprises six loose parts which are illustrated assembled in FIG. 1. The clothes-hanger comprises a central portion 2 which is substantially tubular and is of rectangular cross-section. However, the central portion is not tubular throughout, but has an abutment 8 within the central portion substantially intermediate of the ends of the central portion. A hook 3 with sharp-edged grooves is driven into the central portion 2 above the abutment 8. Two braces 7 are disposed on the central portion for the purpose of reinforcing the hook anchorage.

Two compression springs 4 are introduced into the central portion from its ends, of which compression springs only one is apparent from the drawings. The compression springs are axially guided by ribs 6 which are disposed in the central portion such that a pin 18 on a transverse abutment face at the inner end of an end piece 1 inserted into the central portion 2 may be inserted into one end of the spring 4 for centering thereof. The other end of the spring is arranged to abut against the abutment 8. Furthermore, the distance between the ribs is such that the end piece 1 may be reciprocated in the central portion.

The end piece 1 is provided with a locking device 5 in the form of a locking tongue which is preferably manufactured integrally with the end piece and is disposed with its inner end at the inner end of the end piece. The locking tongue is resilient and is directed towards the outer end of the end piece 1, having the lower edge thereof inclined downwardly toward the free, outer end. In the unbiased condition, the locking tongue 5 is located beneath the lower defining surface 10 of the end piece but can, on the application of a force, be pressed upwardly into a recess 11 disposed in the end piece 1. On insertion of the end piece 1 into the central portion 2, an end edge 12 of the central portion will force the locking tongue upwardly. When the locking tongue 5 has passed an outer defining edge 9 of a slot 14 provided in the lower region 13 of the central portion 2, the locking tongue returns to its unbiased condition and thereby prevents release of the end piece from the central portion. The end surface 16 of the locking tongue 5 is concave in order to realize a reliable engagement with the defining edge 9. The end piece may be separated from the central portion in that a user presses the locking tongue 5 upwardly by means of a finger or a tool, whereafter the user may draw the end piece outwardly, for example for replacement of a broken end piece 1.

In the mounted condition, the end piece may be shifted from the outer position illustrated in FIG. 1 to an inner position where the gripping portion 15 of the end piece abuts against the end edge 12, or until the spring 14 is entirely compressed.

Figure 2:
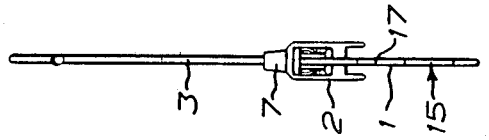
FIG. 2 is a side elevation of the clothes-hanger of FIG. 1.

It will be apparent from FIG. 2 that the end pieces 1 are of I-profile which imparts to the end pieces stability and strength. The I-profiles are such that their shanks abut against the inner defining surfaces of the central portion.

The gripping portions 15 of the end pieces are provided with stepped catches 17 for realizing a reliable engagement with the article of clothing which is to be hung up.

What I claim and desire to secure by Letters Patent is:

1. A clothes-hanger comprising a hollow central portion having an outer end and having a slot in the lower region thereof, the slot having a defining edge adjacent to the outer end thereof, said edge being spaced inwardly from the outer end of the central portion, a suspension member disposed on the central portion, said central portion having abutment means centrally therein, two end pieces, at least one said end piece being telescopically in the central portion in order to be movable between an inner and an outer position in the central portion, the outer ends of said end pieces having gripping portions for engagement with an article of clothing which is to be hung up, said one end piece at its inner end having a transverse abutment face, a compression spring disposed between and abutting said abutment means in the central portion and the abutment face of the end piece telescopically disposed in the central portion, recess means in the bottom of said movable end piece adjacent to and spaced from the transverse abutment face thereof, and a locking device resiliently connected at the inner end thereof to said one end piece with its inner end at the inner end of the one movable end piece and having a free outer end remote from said inner ends, said outer end of said locking piece having end surface means for engaging said defining edge of said slot in said central portion, said locking device extending from its inner end towards said gripping portion of the one end piece and underlying said recess means, said recess means being devoid of any obstruction to movement thereinto of said locking means, the locking device having a lower surface inclined downwardly toward the outer end thereof, said locking device positioned when said inner end of said one end piece is partially inserted into said central portion for engagement of the lower surface thereof with the outer end of the central portion whereby resiliently to move said locking device into said recess means in the said one end piece upon initial insertion thereof and whereby after further insertion said locking device will be caused to snap down into said slot formed in said central portion lower region by the resilient connection, the end surface means at the free outer end of said locking device engaging the defining edge of said slot and being urged thereagainst by said compression spring.

2. The clothes hanger of claim 1, said spring being a coil spring.

3. The clothes hanger of claim 2, and a protrusion extending from said transverse face of said one end piece and entering into said spring.

4. The clothes hanger of claim 2 or 3, said central portion comprising guide means therein for said spring.

5. The clothes hanger of claim 1, said end pieces at their inner end being of I-profile.

* * * * *